US012359333B2

(12) United States Patent
Tripathy

(10) Patent No.: US 12,359,333 B2
(45) **Date of Patent: *Jul. 15, 2025**

(54) METAL-COATED ARTICLES COMPRISING A TRANSITION METAL REGION AND A PLATINUM-GROUP METAL REGION AND RELATED METHODS

(71) Applicant: Battelle Energy Alliance, LLC, Idaho Falls, ID (US)

(72) Inventor: Prabhat K. Tripathy, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/459,966

(22) Filed: Sep. 1, 2023

(65) Prior Publication Data

US 2024/0076793 A1 Mar. 7, 2024

Related U.S. Application Data

(60) Provisional application No. 63/374,394, filed on Sep. 2, 2022.

(51) Int. Cl.

| | |
|---|---|
| ***C25D 5/10*** | (2006.01) |
| ***C25D 3/50*** | (2006.01) |
| ***C25D 3/66*** | (2006.01) |
| ***C25D 5/50*** | (2006.01) |

(52) U.S. Cl.

CPC ..... *C25D 5/10* (2013.01); *C25D 3/50* (2013.01); *C25D 3/665* (2013.01); *C25D 5/50* (2013.01)

(58) Field of Classification Search

None

See application file for complete search history.

(56) References Cited

U.S. PATENT DOCUMENTS

| | | | | |
|---|---|---|---|---|
| 3,770,613 | A | 11/1973 | Chisholm | |
| 3,788,968 | A | 1/1974 | Müller et al. | |
| 5,436,505 | A * | 7/1995 | Hayashi | H01L 29/45 438/653 |
| 11,174,536 | B2 | 11/2021 | Tripathy | |
| 11,635,404 | B2 | 4/2023 | Shaltry et al. | |

(Continued)

FOREIGN PATENT DOCUMENTS

| | | | |
|---|---|---|---|
| GB | 1258372 | A | 12/1971 |
| GB | 1346794 | A | 2/1974 |

OTHER PUBLICATIONS

Kelly et al. Chem. Soc. Rev., 2012, 41, 8021-8034 (Year: 2012).*

(Continued)

*Primary Examiner* — Wojciech Haske

(74) *Attorney, Agent, or Firm* — TraskBritt

(57) ABSTRACT

A metal-coated article that comprises a substrate, a transition metal region adjacent to the substrate, and a platinum-group metal region adjacent to the transition metal region. The transition metal region comprises a transition metal carbide layer adjacent to the substrate. The platinum-group metal region comprises a transition metal/platinum-group metal layer that is adjacent to the transition metal region and a platinum-group metal layer adjacent to the transition metal/platinum-group metal layer. Related methods are also disclosed.

20 Claims, 4 Drawing Sheets

(56) References Cited

U.S. PATENT DOCUMENTS

| | | | | |
|---|---|---|---|---|
| 11,746,434 | B2 | 9/2023 | Tripathy | |
| 2010/0206941 | A1* | 8/2010 | Egan | C09K 3/1445 427/249.1 |
| 2019/0323135 | A1 | 10/2019 | Tripathy | |
| 2020/0324336 | A1 | 10/2020 | Tripathy et al. | |
| 2021/0055248 | A1 | 2/2021 | Tripathy et al. | |
| 2022/0042189 | A1 | 2/2022 | Tripathy | |
| 2022/0049368 | A1 | 2/2022 | Tripathy | |
| 2023/0016315 | A1 | 1/2023 | Tripathy et al. | |
| 2023/0046888 | A1 | 2/2023 | Tripathy | |
| 2023/0069457 | A1 | 3/2023 | Tripathy | |
| 2023/0282378 | A1 | 9/2023 | Tripathy | |

OTHER PUBLICATIONS

Wang et al. Chem. Commun., 2016, 52, 3697--3700 (Year: 2016).*
Bystrov et al. Technical Physics Letters, 2010, vol. 36, No. 6, pp. 570-573 (Year: 2010).*

* cited by examiner

METAL-COATED ARTICLES COMPRISING A TRANSITION METAL REGION AND A PLATINUM-GROUP METAL REGION AND RELATED METHODS

CROSS-REFERENCE TO RELATED APPLICATIONS

This application claims the benefit under 35 U.S.C. § 119(e) of U.S. Provisional Patent Application Ser. No. 63/374,394, filed Sep. 2, 2022, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05-ID14517 awarded by the United States Department of Energy. The government has certain rights in the invention.

TECHNICAL FIELD

The disclosure relates generally to electrodeposition using molten salt electrochemistry and to coated articles. Specifically, the disclosure relates to coated metal articles that include a transition metal region and a platinum-group metal region on a substrate and to related methods of forming the coated metal articles.

BACKGROUND

In some uses for metal-coated substrates, the metal-coated substrate may be subjected to elevated temperatures that degrade the metal and substrate materials. For instance, carbon-based materials (e.g., graphite), metals, or cermets are conventionally used as substrates. Carbon-based substrates are also used in many industries since carbon (e.g., graphite) is relatively inexpensive. The carbon-based materials are abundant and exhibit resistance to corrosion in certain environments, such as in corrosive molten salt environments. However, degradation of bodily integrity of the carbon-based material may occur, and the metal-coated substrate may fail a given intended purpose when exposed to elevated temperatures. While the carbon-based material is able to withstand some corrosive molten salt environments, the carbon-based material becomes a reactive material when subjected to oxidizing conditions, such as in the presence of oxygen or other oxidizing compounds.

BRIEF SUMMARY

Embodiments of the disclosure are directed to a metal-coated article that comprises a substrate, a transition metal region adjacent to the substrate, and a platinum-group metal region adjacent to the transition metal region. The transition metal region comprises a transition metal carbide layer adjacent to the substrate. The platinum-group metal region comprises a transition metal/platinum-group metal layer that is adjacent to the transition metal region and a platinum-group metal layer adjacent to the transition metal/platinum-group metal layer.

A method of forming a metal-coated article is also disclosed. The method comprises electrodepositing a transition metal layer onto a substrate, and converting at least a portion of the transition metal layer to a transition metal carbide to form a transition metal region. A platinum-group metal layer is electrodeposited on the transition metal region and at least a portion of the platinum-group metal layer is converted to a transition metal/platinum-group metal layer on the platinum-group metal layer to form a platinum-group metal region.

A method of forming a metal-coated article is also disclosed. The method comprises forming an as deposited transition metal layer on a substrate and annealing the as deposited transition metal layer to convert at least a portion of the as deposited transition metal layer to a transition metal carbide layer. An as deposited platinum-group metal layer is formed on the transition metal carbide layer. The as deposited platinum-group metal layer is annealed to convert at least a portion of the as deposited platinum-group metal layer to a transition metal/platinum-group metal layer.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
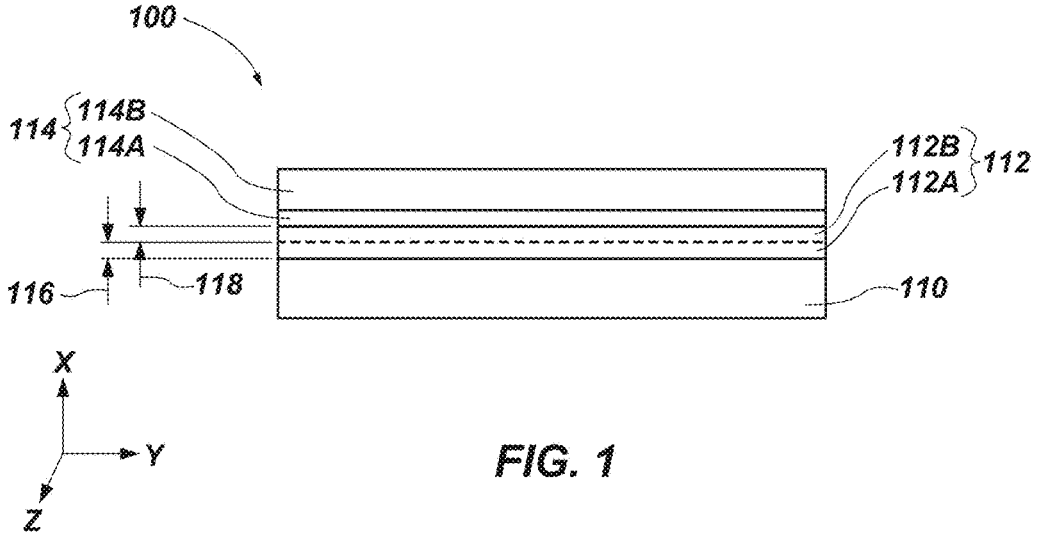
FIG. 1 is a simplified transverse cross-section view of an article in accordance with one or more embodiments of the disclosure.

The following description provides specific details, such as material compositions and processing conditions (e.g., temperatures, current densities, etc.) in order to provide a thorough description of embodiments of the disclosure. However, a person of ordinary skill in the art will understand that the embodiments of the disclosure may be practiced without necessarily employing these specific details. Indeed, the embodiments of the disclosure may be practiced in conjunction with conventional systems and methods employed in the industry. In addition, only those process components and acts necessary to understand the embodiments of the disclosure are described in detail below. A person of ordinary skill in the art will understand that some process components are inherently disclosed herein and that adding various conventional process components and acts would be in accord with the disclosure.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figure. Unless otherwise specified, the spatially relative terms are intended to encompass different orientations of the materials in addition to the orientation depicted in the figure. For example, if materials in the figure are inverted, elements described as "below" or "beneath" or "under" or "on bottom of" other elements or features would then be oriented "above" or "on top of" the other elements or features. Thus, the term "below" may encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "substantially all" means and includes greater than about 95%, such as greater than about 99%.

As used herein, the term "about" in reference to a numerical value for a particular parameter is inclusive of the numerical value and a degree of variance from the numerical value that one of ordinary skill in the art would understand is within acceptable tolerances for the particular parameter. For example, "about" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof.

As used herein, the term "may" with respect to a material, structure, feature or method act indicates that such is contemplated for use in implementation of some embodiments of the disclosure and such term is used in preference to the more restrictive term "is" so as to avoid any implication that other, compatible materials, structures, features and methods usable in combination therewith should or must be excluded.

As used herein, the term "anode" and its grammatical equivalents means and includes an electrode where oxidation takes place.

As used herein, the term "cathode" and its grammatical equivalents means and includes an electrode where reduction takes place.

The illustrations presented herein are not meant to be actual views of any article or related method, but are merely idealized representations, which are employed to describe example embodiments of the disclosure. The figures are not necessarily drawn to scale. Additionally, elements common between figures may retain the same numerical designation.

Embodiments of the disclosure are directed to an article (e.g., a metal-coated article) that includes a substrate, a transition metal region on the substrate, and a platinum-group metal region on the transition metal region. The substrate may be coated with the transition metal region, which may be coated with the platinum-group metal region. The transition metal region includes a transition metal carbide layer and the platinum-group metal region includes a platinum-group metal layer. The transition metal carbide layer is adjacent to the substrate and, in certain embodiments, a transition metal layer is adjacent to the transition metal carbide layer. The platinum-group metal region also includes a transition metal/platinum-group metal layer that is adjacent to the transition metal region. The platinum-group metal region may be the outermost layer of the metal-coated article.

The transition metal region may provide electrical conductivity and mechanical strength to the metal-coated article and the platinum-group metal region may protect the metal-coated article from corrosion and oxidation. The platinum-group metal region may also provide an increased hardness to the metal-coated article. The metal-coated article may, for example, be resistant to oxidation and corrosion, such as oxidation and corrosion present in extreme environments. The metal-coated article may, for example, be configured as an anode of an electrochemical cell or used as a component of a molten salt reactor. When exposed to, for example, a molten salt environment, the metal-coated article may be substantially resistant to oxidation and corrosion at a temperature between about 500° C. and about 1000° C. since the metal-coated article is chemically inert. The transition metal region and the platinum-group metal region of the metal-coated article may also be substantially crack-free, uniform in thickness, smooth and dense.

Methods of forming the metal-coated article are also disclosed and include the deposition (e.g., electrodeposition) of multiple (e.g., two or more) metals, such as a transition metal and a platinum-group metal. The metals are formed as one or more layers (e.g., coatings), on the substrate through electrochemical processing. The metals are deposited (e.g., electrodeposited) from electrolytes that include the desired transition metal and the desired platinum-group metal, such as from a binary alkali metal halide melt or a ternary alkali metal halide melt that includes the desired transition metal or the desired platinum-group metal. The electrolyte may also be an alkaline earth metal salt including, but not limited to, calcium chloride ($CaCl_2$) or calcium bromide ($CaBr_2$). Each deposition act is followed by an annealing act that converts the transition metal into a transition metal carbide, and the platinum-group metal into a transition metal/platinum-group metal. The multiple deposition acts and multiple anneal acts form the transition metal region and the platinum-group metal region as smooth, thick, adherent layers on the substrate. The metal-coated article may be formed at a temperature of less than or equal to about 500° C.

FIG. 1 is a simplified transverse cross-section view of an article 100 (e.g., a metal-coated article) in accordance with one or more embodiments of the disclosure. The article 100 includes a substrate 110, a transition metal region 112 on the substrate 110, and a platinum-group metal region 114 on the transition metal region 112. Each of the transition metal region 112 and the platinum-group metal region 114 may include one or more material layers, such as one or more transition metal layers and one or more platinum-group metal layers. The transition metal region 112 and the platinum-group metal region 114 form a bilayer body on the substrate 110. The substrate 110 may be coated with the transition metal region 112, which may be coated with the platinum-group metal region 114. The article 100 may exhibit high temperature stability and a high degree of chemical inertness in the presence of oxygen.

The substrate 110 may be thermally conductive and electrically conductive. The substrate 110 may be an inorganic material including, but not limited to, a boron-doped diamond (BDD) material, a molybdenum disilicide (MOxSiy) material, a graphite material, a boron doped graphite material, a lanthanum chromite ($LaxCryO_3$)-based material, a perovskite material, such as $FeTiO_3$, a silicone material, or a combination thereof. The substrate 110 may also be a metallic material (e.g., a metal) including, but not limited to, a tantalum material, a nickel material, a chromium material, a copper material, stainless steel, a titanium material, such as one of rutile or anatase morphologies of $TiO_2$, or a combination thereof. In some embodiments, the substrate 110 is BDD. In other embodiments, the substrate 110 is graphite. If the substrate is a metal or other non-carbon containing material, then a thin carbon layer (not shown) may be formed over the metal or other non-carbon containing material as part of the substrate.

The transition metal region 112 may be formed of and include at least one transition metal carbide layer 112A and an optional transition metal layer 112B, which is indicated in FIG. 1 by dashed lines. Therefore, the transition metal carbide layer 112A may directly contact the substrate 110 and may contact the transition metal layer 112B, as shown in FIG. 1. In other words, the transition metal carbide layer 112A may be positioned between the substrate 110 and, if present, the transition metal layer 112B. The transition metal carbide layer 112A includes atoms of carbon and atoms of one or more transition metal elements. The optional transition metal layer 112B includes atoms of the one or more transition metal elements. The transition metal element may include, but is not limited to, nickel, chromium, tantalum, titanium, niobium, tungsten, zirconium, hafnium, molybdenum, tungsten, vanadium, iron, nickel, cobalt, or a combination thereof. In some embodiments, the transition metal element is titanium. In other embodiments, the transition metal element is vanadium. In yet other embodiments, the transition metal element is tantalum. While FIG. 1 illustrates the transition metal region 112 as including the transition metal carbide layer 112A and the transition metal layer 112B, the transition metal region 112 may include the transition metal carbide layer 112A if no transition metal layer 112B is present.

The transition metal carbide layer 112A may be a substantially homogeneous chemical composition or may be a heterogeneous chemical composition throughout its thickness. The transition metal carbide layer 112A includes carbon from the substrate 110 and the transition metal element, with varying relative amounts of carbon and transition metal. The transition metal carbide layer 112A may be formed of and include compounds of carbon and the transition metal, such as stoichiometric compounds or non-stoichiometric compounds of carbon and the transition metal. Alternatively, the transition metal carbide layer 112A may include a gradient of carbon in the transition metal. The transition metal carbide layer 112A may, for example, transition in chemical composition from including the atoms of carbon and the atoms of one or more transition metal elements to including substantially atoms of the transition metal layer 112B, if present. In some embodiments, the transition metal layer 112B is adjacent to the transition metal carbide layer 112A and is an unreacted transition metal that provides a structural and material transition between the transition metal carbide layer 112A and the platinum-group metal region 114.

Figure 2:
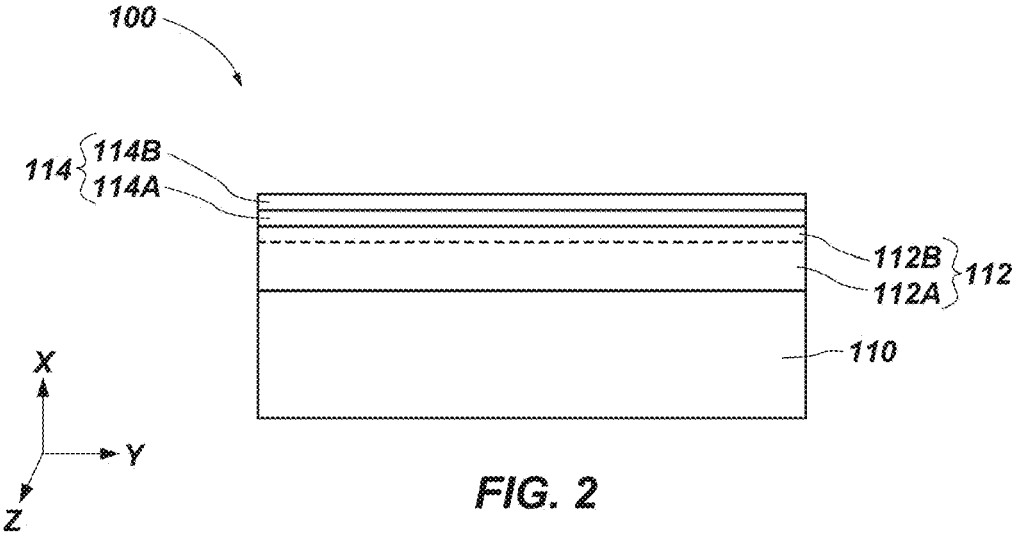
FIG. 2 is a simplified transverse cross-section view of an article in accordance with one or more embodiments of the disclosure.
Figure 3:
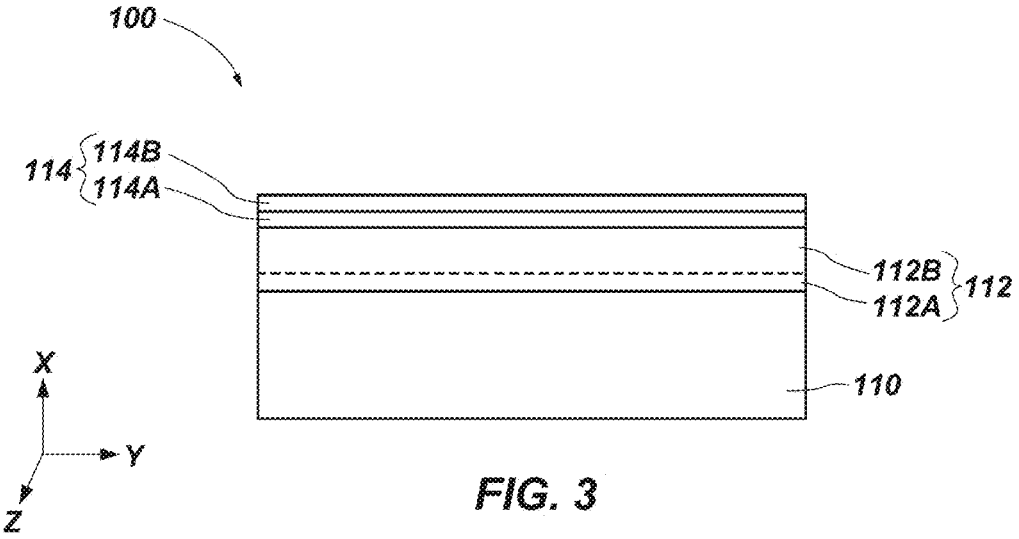
FIG. 3 is a simplified transverse cross-section view of an article in accordance with one or more embodiments of the disclosure.
Figure 4:
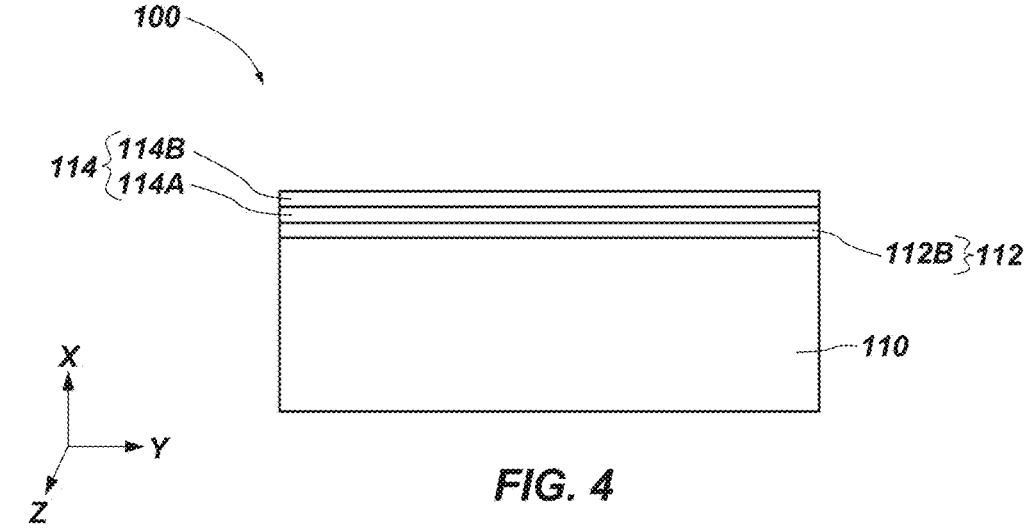
FIG. 4 is a simplified transverse cross-section view of an article in accordance with one or more embodiments of the disclosure.

If the transition metal layer 112B is present, the transition metal carbide layer 112A may account for a greater relative portion of the transition metal region 112 than the transition metal layer 112B. A relative thickness of the transition metal carbide layer 112A may be greater (in the X-direction) than a relative thickness (in the X-direction) of the transition metal layer 112B. The transition metal carbide layer 112A may account for greater than or equal to about 51% of a total thickness of the transition metal region 112 and the transition metal layer 112B may account for less than or equal to about 49% of the total thickness of the transition metal region 112. By way of example only, a ratio of the thickness of the transition metal carbide layer 112A to the thickness of the transition metal layer 112B may be about 3:1. For instance, the transition metal region 112 may have the transition metal carbide layer 112A with a thickness 116 that accounts for about three-fourths of the total thickness of the transition metal region 112, and the transition metal layer 112B may have a thickness 118 that accounts for about one-fourth (or the remainder) of the transition metal region 112, as shown in FIG. 2. The thickness (X-direction) of the transition metal region 112 may be from about 10 micrometer (μm) to about 4 millimeters (mm), such as from about 2 mm to about 4 mm, from about 1 mm to about 2 mm, or from about 10 μm to about 1 mm, with the transition metal carbide layer 112A being relatively thicker than the transition metal layer 112B. The thickness ratio of the transition metal carbide layer 112A to the transition metal layer 112B may include, but is not limited to, 2:1, 4:1, 5:1, or 6:1. In other embodiments, the transition metal layer 112B may account for greater than or equal to about 51% of a total thickness of the transition metal region 112 and the transition metal carbide layer 112A may account for less than or equal to about 49% of the total thickness of the transition metal region 112, as seen in FIG. 3. In yet other embodiments, the transition metal region 112 may include the transition metal carbide layer 112A in its entirety if the transition metal layer 112B is not present, as seen in FIG. 4.

The metal-coated article 100 also includes the platinum-group metal region 114 over (e.g., above) the transition metal region 112. The platinum-group metal region 114 may include a transition metal/platinum-group metal layer 114A above the transition metal carbide layer 112A or above the transition metal layer 112B, if present. A platinum-group metal layer 114B may be above the transition metal/platinum-group metal layer 114A. The transition metal/platinum-group metal layer 114A and the platinum-group metal layer 114B may be partially or completely, respectively, made of a platinum-group metal element. The platinum-group metal element may include, but is not limited to, platinum, palladium, rhodium, iridium, ruthenium, osmium, or a combination thereof. The platinum-group metal element may exhibit a close packed hexagonal structure. In some embodiments, the platinum-group metal element is osmium. In other embodiments, the platinum-group metal element is ruthenium. By way of example only, platinum, palladium, rhodium, or iridium may be used in the metal-coated article 100 for applications at temperatures less than about 1000° C., such as about 650° C., about 700° C., or about 850° C. On the other hand, ruthenium or osmium may be present in the metal-coated article 100 may be used in the metal-coated article 100 for applications at temperatures less than about 1000° C., as well as applications at temperatures greater than about 1000° C.

The platinum-group metal layer 114B may function as an outer coating of the metal-coated article 100. The platinum-group metal region 114 may be a dense (e.g., not porous) material. The transition metal/platinum-group metal layer 114A may be a metal-metal transition layer between and contacting opposite surfaces, with one surface in contact with the platinum-group metal layer 114B and an opposite surface in contact with the transition metal region 112, such as the transition metal carbide layer 112A or the transition metal layer 112B, if present. A chemical composition of the transition metal/platinum-group metal layer 114A may transition between the chemical composition of the transition metal carbide layer 112A or the transition metal layer 112B and the chemical composition of the platinum-group metal layer 114B. The transition metal/platinum-group metal layer 114A may include a homogeneous chemical composition of the transition metal and the platinum-group metal or a heterogeneous composition of the transition metal and the platinum-group metal, such as a gradient. Without being bound by any theory, is it believed that the close packed hexagonal structure of the platinum-group metal element provides hardness to the platinum-group metal region 114.

A thickness of the platinum-group metal region 114 may be sufficient to provide the corrosion and oxidation resistance properties to the article 100. However, since platinum-group metals are expensive, the platinum-group metal region 114 may be sufficiently thin such that the article 100 is less expensive compared to conventional articles that include the platinum-group metal as a monolithic body.

Figure 5:
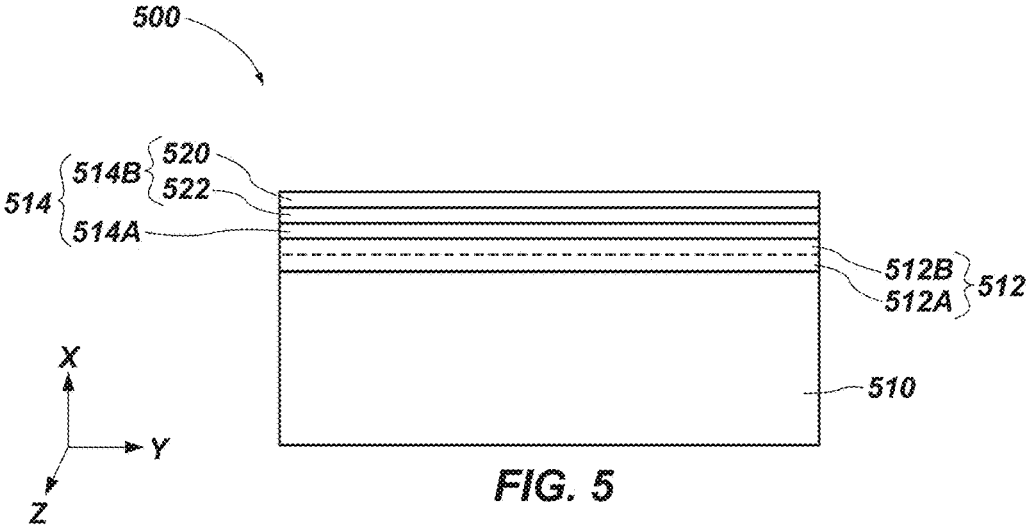
FIG. 5 is a simplified transverse cross-section view of an article in accordance with one or more embodiments of the disclosure.

Referring to FIG. 5, in contrast to having a single platinum-group metal layer in the platinum-group metal layer 114B as illustrated in FIGS. 1-4, multiple (e.g., two or more) sequential layers of platinum-group metals 520 and 522 may be present in the platinum-group metal layer 514B. A metal-coated article 500 is illustrated, including a substrate 510 and a transition metal region 512, the transition metal region 512 further including a transition metal carbide layer 512A and an optional transition metal layer 512B. Further, the platinum-group metal region 514 includes a platinum-group metal transition section layer 514A and the platinum-group metal layer 514B. The platinum-group metal transition section layer 514A may exhibit a chemical composition that transitions between the chemical composition of the transition metal region 512 and the platinum-group metal region 514. Each of the two or more layers of platinum-group metals 520 and 522 may be formed of the same platinum-group metal or of different platinum-group metals. Similar to the article 500 including two platinum-group metal layers 520, 522 in the platinum-group metal layer 514B, the article 500 may include multiple (not illustrated) sequential layers of transition metals as part of the transition metal region 512.

Figure 6:
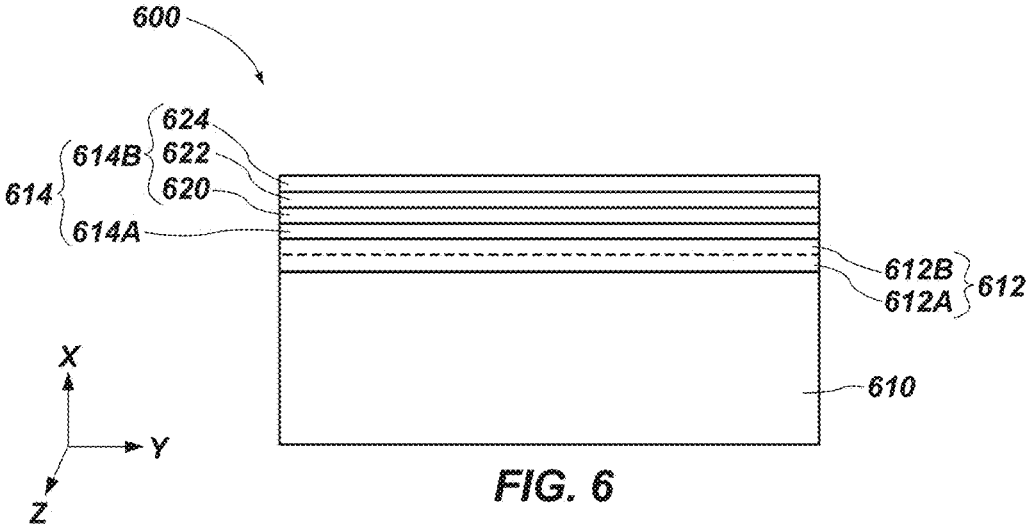
FIG. 6 is a simplified transverse cross-section view of an article in accordance with one or more embodiments of the disclosure.

In FIG. 6, a coated article 600 is illustrated, including a substrate 610 and a transition metal region 612, the transition metal region 612 further including a transition metal carbide layer 612A and an optional transition metal layer 612B. Further, a platinum-group metal region 614 includes a platinum-group metal transition section layer 614A and a platinum-group metal layer 614B. The platinum-group metal transition section layer 614A may exhibit a chemical composition that transitions between the chemical composition of the transition metal region 612 and the platinum-group metal region 614. The platinum-group metal layer 614B may be sequentially formed of more than one platinum-group metal layer. By way of example only, the more than one sequential platinum-group metal layer may include three sequential platinum-group metal layers 620, 622, and 624. The more than one sequential platinum-group metal layers may be formed of the same platinum-group metal or of different platinum-group metals. Similar to the article 600 including more than one sequential platinum-group metal layer in the platinum-group metal layer 614B, the article 600 may include more than one sequential transition metal layers (not illustrated) as part of the transition metal region 612.

Figure 7:
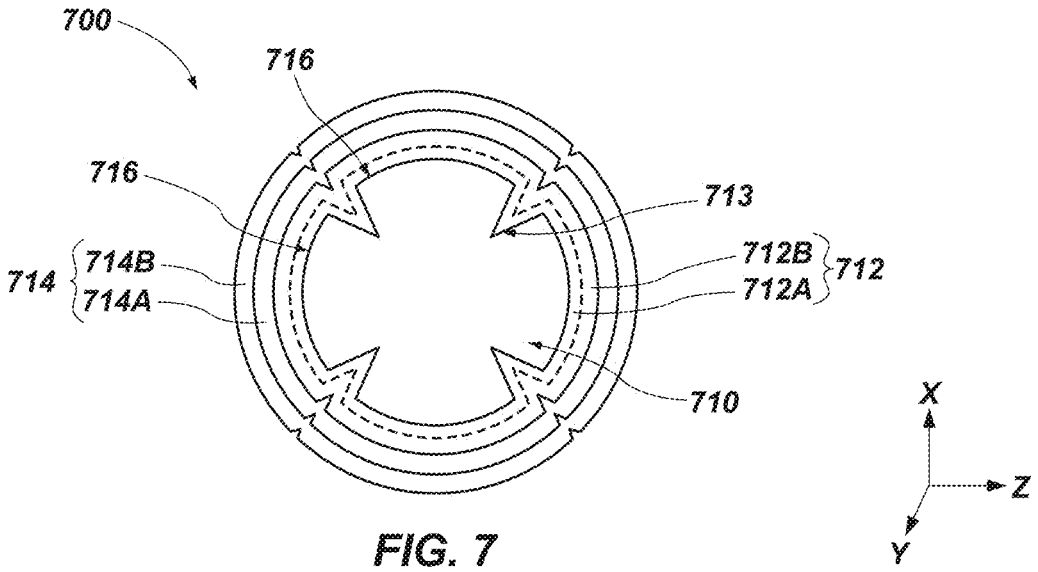
FIG. 7 is a simplified top down view of an article, taken orthogonal to views depicted in FIGS. 1-6, in accordance with one or more embodiments of the disclosure.

The metal-coated articles 100, 500, 600 may be configured as a functionalized inert electrode. FIG. 7 is a simplified transverse cross-section view of a functionalized inert electrode 700, in accordance with one or more embodiments of the disclosure. Compared to the articles 100, 500, 600 illustrated in FIGS. 1-6, which have substantially planar (X-direction) layers in the regions 112/114, the functionalized inert electrode 700 may have optional indentations 713 that interrupt an otherwise curvilinear (Z-direction) structures on a surface 716 of the substrate 710. The inert electrode 700 includes a substrate 710, a transition metal region 712 on the substrate 710, and a platinum-group metal region 714 on the transition metal region 712. The transition metal region 712 includes a transition metal carbide layer 712A and an optional transition metal layer 712B. The platinum-group metal region 714 includes a transition metal/platinum-group metal layer 714A and a platinum-group metal layer 714B. The surface 716 of the substrate 710 defines substantially radial boundaries of substrate 710, with interrupted radial boundaries including indentations 713 within the substrate 710 at the surface 716. In each embodiment of the disclosure relating to FIG. 7, the indentations 713 may be reflected through subsequent layers, up to and including the platinum-group metal layer 714B. The presence of the at least one indentation 713 increases the effective surface area of the substrate 710, to which the transition metal carbide layer 712A and optional transition metal layer 712B may adhere. In some embodiments there are no indentations 713 present.

The metal-coated article 100, 500, 600, 700 may be formed by electrochemical processing (e.g., electrodepositing, electroplating) the one or more materials onto the substrate 110. Alternatively, the one or more materials of the transition metal region 112 and the platinum-group metal region 114 may be formed by spraying, painting, or duplexing. Forming the metal-coated article 100 by electrodeposition may enable thicknesses of the materials of the transition metal region 112 and the platinum-group metal region 114 to be controlled. The materials of the transition metal region 112 and the platinum-group metal region 114 may be formed in multiple deposition acts. For instance, the one or more materials of the transition metal region 112 may be formed on the substrate 110 by one or more electrodeposition acts, and the one or more materials of the platinum-group metal region 114 may be formed on the transition metal region 112 by one or more electrodeposition acts. The electroplating may be conducted using an electrolyte, such as an alkali halide salt melt electrolyte, as a source of primary electrolyte. The electrolyte may include an auxiliary electrolyte that includes one or more halides of transition metals and platinum group metals, which provides a thermodynamic and kinetic pathway for a metal(s) in a functional electrolyte of the electrolyte to deposit onto the substrate 110. The electrolyte may be a binary or a ternary alkali halide salt melt. The functional electrolyte may make up a portion of a total volume of the alkali halide salt melt, such as in a range of from about 60 weight percent (wt. %) to about 90 wt. % of the alkali halide salt melt or from about 60 wt. % to about 80 wt. % of the alkali halide salt melt. The auxiliary electrolyte may account for from about 10 wt. % to about 40 wt. % of the alkali halide salt melt. The alkali halide salt melt may, for example, include only the auxiliary electrolyte and the functional electrolyte.

The transition metal region 112 may be formed of at least one desired transition metal, where the auxiliary electrolyte is an alkali metal salt melt and the functional electrolyte includes the desired transition metal. Electroplating of the transition metal may be done in an inert (e.g., non-reactive) atmosphere, e.g., argon or helium. Using the inert atmosphere allows the transition metal of the transition metal region 112 to cool after deposition without getting oxidized. Electrochemical processing conditions include heating to a temperature range of from about 300° C. to about 600° C., for an amount of time ranging from about 30 minutes to about 5 hours.

Forming an as-deposited transition metal layer of the transition metal region 112 on the substrate 110 may include using an alkali metal bromide melt, where the transition metal is dissolved as the functional electrolyte in the alkali metal bromide melt and is plated onto the substrate 110 during the electroplating process. The alkali metal bromide melt may include, but is not limited to, a lithium bromide melt, a potassium bromide melt, a sodium bromide melt, a cesium bromide melt, or a combination thereof. Alternatively, an alkali metal chloride melt or an alkali metal fluoride melt may be used to dissolve and plate the transition metal. The alkali metal bromide melt may include, for example, a ternary molten salt that includes various mole percentages (mol %) of each of lithium bromide (LiBr), potassium bromide (KBr), and cesium bromide (CsBr). By way of nonlimiting example, the mol % of the ternary molten salt may include 56.1 LiBr—18.9 KBr—25 CsBr (mol %), 59.5 LiBr—33.5 KBr—7CsBr (mol %), 50.5 LiBr—28.5 KBr—21 CsBr (mol %), or 61.1 LiBr—13.5 KBr—25.4 CsBr (mol %). The electrolyte may, alternatively, include lithium chloride (LiCl) or calcium chloride $CaCl_2$ and calcium oxide (CaO). Forming the transition metal region 112 may include the deposition of more than one as-deposited transition metal layer on the substrate 110.

By way of example only, the functional electrolyte used to form the as-deposited transition metal layer may include a tungsten-containing functional electrolyte, a molybdenum-containing functional electrolyte, a vanadium-containing functional electrolyte, a titanium-containing functional electrolyte, or other transition metal containing functional electrolyte. The transition metal containing functional electrolyte may be formed by using a corresponding bromide salt including, but not limited to, titanium tetrabromide ($TiBr_4$), molybdenum bromide ($MoBr_3$), tantalum(V) bromide ($TaBr_5$), nickel bromide ($NiBr_2$), chromium bromide ($CrBr_3$), ruthenium bromide ($RuBr_3$), osmium bromide ($OsBr_4$), or copper bromide ($CuBr/CuBr_2$).

The electrochemical process for the formation of the as-deposited transition metal layer and the as-deposited platinum-group metal layer may be conducted in an electrochemical processing system, such as the electrochemical processing system 900 shown in FIG. 9 discussed below. The electrochemical processing system may be configured as an electrochemical cell that includes a crucible that contains the electrolyte (e.g., a molten alkali metal salt electrolyte), a working electrode (also referred to as a cathode), a counter electrode (also referred to as an anode), and an optional reference electrode. The working electrode may function as the substrate 110. A potentiostat or DC power supply may be configured to measure and/or provide an electric potential between the counter electrode and the working electrode. The difference between the electric potential of the counter electrode and the electric potential of the working electrode may create a cell potential of the electrochemical cell. This cell potential drives the production of the transition metal layer on the substrate 110.

An annealing act is conducted on the as-deposited transition metal layer before forming the platinum-group metal region 114 on the transition metal region 112. The annealing act may convert at least a portion of the as-deposited transition metal layer to the transition metal carbide layer 112A. The transition metal carbide layer 112A may function as an interlayer between the substrate 110 and the transition metal layer 112B, if present, or the platinum-group metal region 114. During the anneal, a portion of the as-deposited transition metal layer may not be converted (e.g., remain in its as-deposited form), forming the transition metal region 112 including the transition metal layer 112B and the transition metal carbide layer 112A. If, however, substantially all of the as-deposited transition metal layer is converted to the transition metal carbide layer 112A, the transition metal region 112 may be formed of and include the transition metal carbide layer 112A. In other words, the transition metal region 112 may lack the transition metal layer 112B. Therefore, the transition metal carbide layer 112A may directly contact the substrate 110 and the transition metal/platinum-group metal layer 114A.

The anneal conditions may include heating the as-deposited transition metal layer to a temperature of from about 500° C. to about 600° C., for a time period of from about 1 hour to about 12 hours. The anneal temperature and anneal time may be adjusted to achieve partial conversion or full conversion of the as-deposited transition metal layer to the transition metal carbide layer 112A. For instance, the anneal temperature may be decreased and the anneal time increased to achieve the desired degree of conversion of the as-deposited transition metal layer to the transition metal carbide layer 112A. The anneal may be conducted in an inert-gas environment, such as with helium (He) or argon (Ar), to enable the transition metal of the transition metal layer to cool after deposition without being oxidized.

Following the anneal, the transition metal carbide layer 112A may form a functionalized bond to the substrate 110, such that physical integrity of the transition metal region 112 is maintained above the substrate 110 during usage such as molten salt deposition processing, where the metal-coated article 100 is a cathode for the second deposition of a platinum group metal. Further, achievement of the transition metal carbide layer 112A improves electrical conductivity when the metal-coated article 100 is used as a cathode.

The platinum-group metal region 114 may be formed after conducting the annealing act on the transition metal region 112. The substrate 110, the transition metal carbide layer 112A, and the transition metal layer 112B, if present, may function as a cathode onto which the platinum-group metal region 114 is electroplated. The substrate 110, the transition metal carbide layer 112A, and the transition metal layer 112B, if present, or the substrate 110 and the transition metal carbide layer 112A may also be referred to herein as a composite electrode. The platinum-group metal region 114 may be formed using a ruthenium-containing functional electrolyte in an alkali metal bromide melt, an iridium-containing functional electrolyte in an alkali metal bromide melt, or a platinum-containing functional electrolyte in an alkali metal bromide melt. Other platinum-group metal containing functional electrolytes may be used. Additionally, an alkali metal chloride melt or an alkali metal fluoride melt may be used. Forming the platinum-group metal region 114 may include the deposition of more than one as-deposited platinum-group metal layer on the transition metal region 112.

The alkali metal bromide melt may include, for example, a ternary molten salt that incorporates various mole percentages (mol %) of each of lithium bromide (LiBr), potassium bromide (KBr), and cesium bromide (CsBr). By way of nonlimiting example, the mol % of the ternary molten salt may include 56.1 LiBr—18.9 KBr—25 CsBr (mol %), 59.5 LiBr—33.5 KBr—7CsBr (mol %), 50.5 LiBr—28.5 KBr—21CsBr (mol %), and 61.1 LiBr—13.5 KBr—25.4 CsBr (mol %). The platinum-group metal containing functional electrolyte may be formed using bromide salts that include, but are not limited to, ruthenium(III) bromide ($RuBr_3$), osmium(III) bromide ($OsBr_3$), iridium(III) bromide ($IrBr_3$), or platinum(II) bromide ($PtBr_2$).

Adhesion of the platinum-group metal region 114 to the transition metal region 112 may be achieved by conducting a second anneal act after depositing the platinum-group metal layer. Annealing conditions of the second anneal may change a chemical composition of a portion of the as-deposited platinum-group metal layer, forming the transition metal/platinum-group metal layer 114A on the transition metal carbide layer 112A or the transition metal layer 112B, if present. Forming the platinum-group metal region 114 including the transition metal/platinum-group metal layer 114A and the platinum-group metal layer 114B provides functionalized corrosion resistance in oxidizing environments such as oxygen-exposed molten salt electrochemical processing to the articles 100, 500, 600, 700. Further, the platinum-group metal layer 114B also protects the transition metal region 112 from degradation due to the presence of oxygen during the molten salt electrochemical processing. Electrochemical processing may be carried out (e.g., conducted) with the fabricated inert anode, which is exposed to oxygen during the electrochemical reduction of metal oxides to metals/alloys, where the anode gets exposed to an oxidizing environment containing significant amounts of oxygen in molten salts.

The annealing conditions for the second anneal include heating the as-deposited platinum-group metal layer to a temperature of from about 500° C. to about 900° C., for a time period of from about 1 hour to about 12 hours, and in an inert-gas environment such as with helium (He) or argon (Ar).

Figure 8:
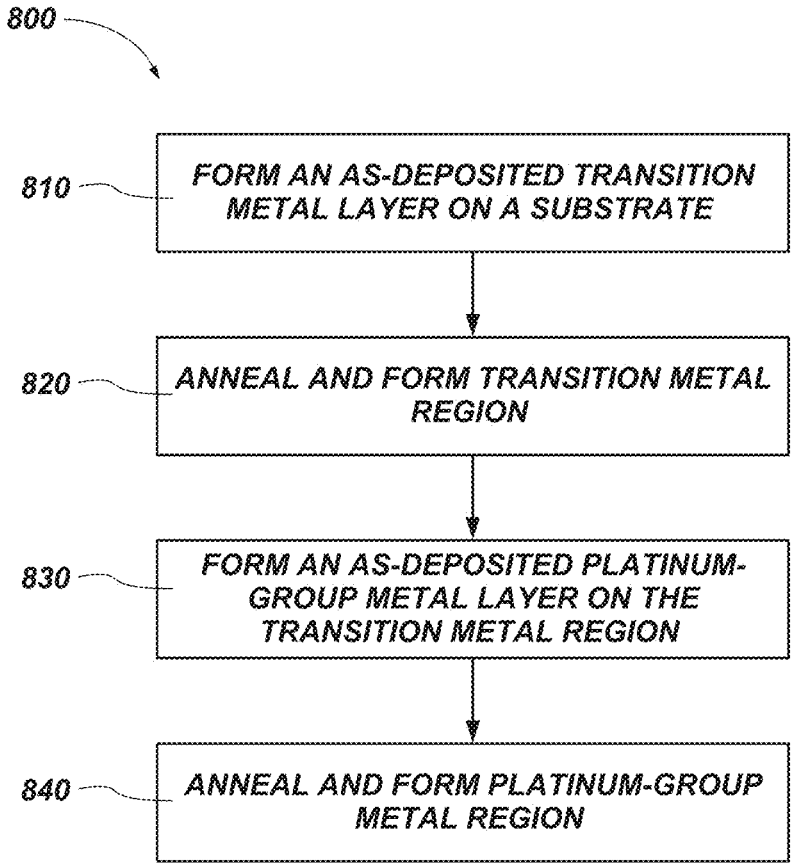
FIG. 8 is a schematic block diagram for forming an article, including a transition metal region on a substrate, and a platinum-group metal region on the transition metal region according to some embodiments of the disclosure.

FIG. 8 is a simplified process flow diagram 800 that illustrates a method of forming the article 100, 500, 600, 700 according to embodiments of the disclosure. The functional electrolyte functions as a source of the metal or metals to be deposited as the plated metal regions, including using a transition metal functional electrolyte to form the transition metal region, and using a platinum-group metal functional electrolyte to form the platinum-group metal region. The auxiliary electrolyte provides both a thermodynamic and kinetic chemical pathway, through which the metals in the functional electrolytes may pass to be deposited upon a cathode of an electrode assembly. The auxiliary electrolyte and the functional electrolytes are used as halide electrolyte components of a salt melt, which may be referred to as a molten salt electrochemical processing bath during electrochemical processing conditions. The disclosed method is relatively inexpensive, simple, and formulated to deposit metals and metal alloys onto simple or complex geometry substrates, allows for ready control of layer thickness, avoids oxygen contamination particularly in the substrate, and uses post-coating treatments. The disclosed method provides uniform surface coverage of the substrate, is effectuated at a relatively low temperature compared with conventional physical and chemical vapor deposition techniques, uses economical salts as feedstocks, uses inexpensive equipment, and is readily scalable.

Prior to electrochemical processing, the substrate to be plated, such as the substrate 110 (e.g., FIG. 1) may be cleaned and then attached (e.g., electrically connected) to a working electrode (e.g., the cathode) of an electrode assembly and placed in a molten salt electrochemical processing bath. Current from a power source is applied to the cathode to produce a negative charge on the cathode. The negative charge combines with the positively charged metal ions in the molten salt electrochemical processing bath to form the plated metal onto the substrate. A current density may be between about 50 Amp/$ft^2$ and about 600 Amp/$ft^2$. However, the current density may also be adjusted based upon the remaining amount of metal(s) within the molten salt electrolyte, as amounts decrease toward a depleted amount of the functional electrolyte metal(s) to be deposited. The current density may also be adjusted based upon the composition of the molten salt electrolyte and electrolysis temperature. The current may be applied for from about 30 minutes to about 300 minutes, although other times may be used depending on the desired thickness of the plated metal. Longer times are associated with thicker metal layers formed on the substrate. The thickness of the metal layers may be proportional to the electrochemical processing time.

The electrochemical processing of the transition metal region 112 and the platinum-group metal region 114 may be conducted in a single vessel. Alternatively, the electrochemical processing may be conducted in separate vessels, one vessel containing a transition metal functional electrolyte, and another vessel containing a platinum-group metal functional electrolyte. Between forming the transition metal region and forming the platinum-group metal region, anneal acts may be done to form transition metal compounds with the substrate.

At act 810, the method includes forming an as-deposited transition metal layer on a substrate, such as forming the as-deposited transition metal layer on the substrate 110 (FIG. 1). In some embodiments, forming the as-deposited transition metal layer includes using a molten salt melt with an auxiliary electrolyte such as cesium bromide, to form a thermodynamic and kinetic deposition pathway to deposit a transition metal from the functional electrolyte onto the substrate.

The method includes removing halide salts from the as-deposited transition metal layer. After plating the substrate 110 (e.g., FIG. 1) with the as-deposited transition metal layer, an intermediate structure is removed from the salt melt and rinsed with a liquid under conditions to remove unplated functional electrolyte of the transition metal, as well as any auxiliary electrolyte. Removing the halide salts may also be conducted using pre-heated gases that are inert to further reacting with the as-deposited transition metal layer. The pre-heated inert gases may use heat energy derived from the molten salt electrochemical processing bath.

The method includes forming at least some transition metal compounds with the substrate by heat treating, such as by conducting annealing act 820. The anneal conditions may include exposing the as-deposited transition metal layer on the substrate 110 to a temperature within a range from about 500° C. to about 900° C., for a time period of from about 1 hour to about 12 hours, and in an inert-gas environment such as with helium (He) or argon (Ar). At least a portion (e.g., half) of the mass of the as-deposited transition metal layer may be converted to a transition metal compound, such as a transition metal carbide, when the substrate 110 (e.g., FIG. 1) is a carbonaceous substrate. If the substrate is a carbonaceous material, a transition metal carbide layer 112A may form by carbiding at least a portion of the as-deposited transition metal layer with the carbonaceous material of the substrate 110. The anneal act 820 produces the transition metal region 112 including the transition metal carbide layer 112A and a transition metal layer 112B (e.g., FIG. 1), if present.

At act 830, the method includes forming an as-deposited platinum-group metal layer on the transition metal region 112. An alkali halide salt melt that includes the alkali halide as the auxiliary electrolyte, is used to dissolve a platinum-group metal containing functional electrolyte, and the platinum-group metal is plated onto the transition metal region 112 to form the as-deposited platinum-group metal layer.

The method includes removing halide salts from the as-deposited platinum-group metal layer. At act 840, the method includes conducting a second anneal act to form the platinum-group metal region 114, the platinum-group metal region 114 including the transition metal/platinum-group metal layer 114A and a platinum-group metal layer 114B (e.g., FIG. 1). The platinum-group metal materials of the platinum-group metal region 114 may be formed above the transition metal region 112.

Figure 9:
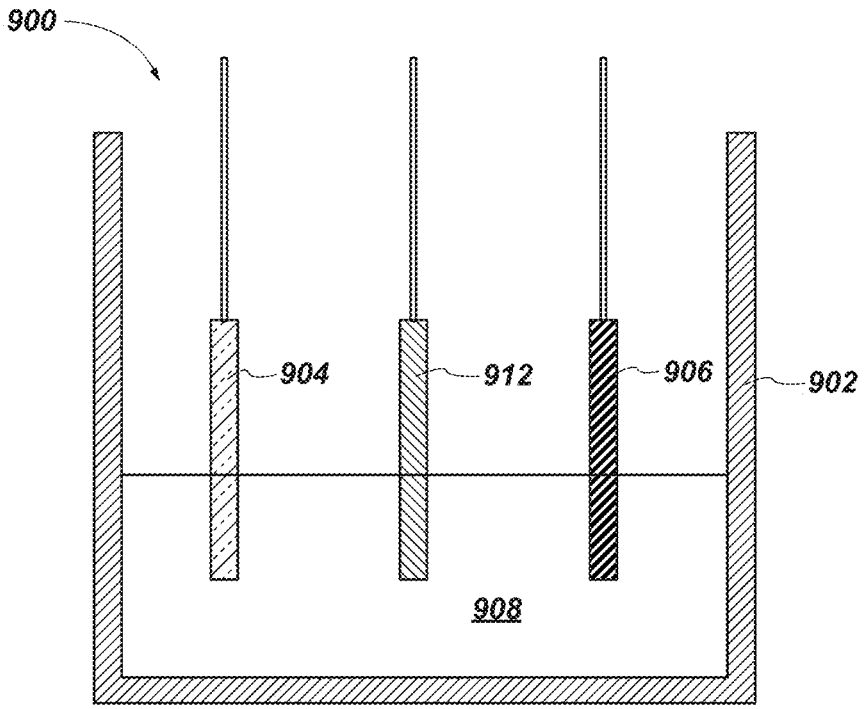
FIG. 9 is a simplified diagram of an electrochemical cell according to some embodiments of the disclosure.

FIG. 9 is a simplified diagram of an electrochemical processing system 900 that may be used for the electrodeposition of the as-deposited transition metal layer and the as-deposited platinum-group metal layer for the formation of the article 100, 500, 600, 700 (e.g., the metal-coated article) according to some embodiments of the disclosure. By way of example only, the electrochemical processing system 900 may be used to form the article 100, 500, 600, 700, such as those shown in FIGS. 1-7. In some embodiments, an inert functional electrode is used to form selected metallic products, where an anode 906 is a functionalized electrode embodiment. The electrochemical processing system 900 may be configured as an electrochemical cell that includes a crucible 902, a working electrode 904 (also referred to as a cathode), a counter electrode 906 (also referred to as the anode), an electrolyte 908 (e.g., a molten alkali metal salt electrolyte), and an optional reference electrode 912. The working electrode 904 may function as a substrate for one or more metals dissolved in the functional electrolyte to form materials such as the transition metal region 112, (e.g., FIG. 1), and platinum-group metal region 114, (e.g., FIG. 1). The transition metal and the platinum-group metal to be plated to form each of the transition metal region 112 and subsequently the platinum-group metal region 114, are supplied in the electrolyte salt melt as oxides of such metals.

The electrochemical processing system 900 may be housed in an atmosphere-controlled environment such as in a so-called "glove box," such as an argon or helium-containing atmosphere glove box, to reduce exposure of sensitive components to moisture and/or oxygen. The crucible 902 is configured to contain the molten salt electrolyte 908. Cathodic reduction is conducted to form the transition metal region 112 on the working electrode 904 and the platinum-group metal region 114 on the transition metal region 112. Each of the working electrode 904, the counter electrode 906, and the reference electrode 912 is at least partially disposed in the molten salt electrolyte 908 and in electrochemical contact with the molten salt electrolyte 908. When an electrical potential is applied between the working electrode 904 and the counter electrode 906, the metal(s) to be plated onto the working electrode 904, may be chemically reduced in the electrochemical processing system 900.

The molten salt electrolyte 908 may be maintained at a temperature of from about 350° C. to about 500° C. when used to reduce the metal(s) and to plate the resulting metal(s) onto the working electrode 904. Alternately, higher temperatures may be used, for example, up to about 950° C. The molten salt electrolyte 908 may be formulated to exhibit a melting temperature within a range of from about 350° C. to about 500° C., such as from about 350° C. to about 425° C., or from about 350° C. to about 450° C. The molten salt electrolyte 908 may be maintained at a temperature such that the molten salt electrolyte 908 is, and remains, in a molten state. In other words, the temperature of the metal(s) to be reduced and plated onto the working electrode 904, may be maintained at or above a melting temperature of the molten salt electrolyte 908. However, the use of lower temperatures may be useful. For example, keeping the molten salt electrolyte 908 at a lower temperature may utilize less energy.

For reducing the metal(s) and/or electrochemical processing the resulting metal(s) onto the working electrode 904, the current density may be between about 50 Amp/ft$^2$ and about 600 Amp/ft$^2$. The current density may also be adjusted based upon the remaining amount of metal(s) within the molten salt electrolyte 908, as amounts decrease toward a depleted amount of the functional electrolyte metal(s) to be deposited. The current density may also be adjusted based upon the composition of the molten salt electrolyte 908 and electrolysis temperature.

Agitation of the molten salt electrolyte 908 may be conducted to make contact between unreacted metal(s) to be reduced and deposited onto the working electrode 904, with as-yet unreduced metal(s) to retain a quasi-batch stirred-tank reactor (BSTR) environment within the molten salt electrolyte 908 and the remaining unplated metal(s). An amount of agitation may depend, in part, on the composition and viscosity of the molten salt electrolyte 908 in a dynamically changing BSTR environment. The agitation may be done by external processes, such as by inductive stirring. The quasi-batch stirred-tank reactor environment may be changed by introducing more of the metal(s) to be plated onto the working electrode 904 into the molten salt electrolyte 908, as the metal(s) are reduced and depleted from an original amount.

The crucible 902 may be formed of and include a ceramic material (e.g., alumina, magnesia (MgO), boron nitride (BN)), graphite, or a metallic material (e.g., nickel, stainless steel, molybdenum, or an alloy of nickel including chromium and iron, such as Inconel®, commercially available from Special Metals Corporation of New Hartford, New York).

The counter electrode 906 may include a coated article 100, 500, 600, 700, such as those described above and illustrated in FIGS. 1-7, that includes the transition metal region 112 and the platinum-group metal region 114. The counter electrode 906 may, alternatively, be a carbonaceous material or a non-carbonaceous material. The counter electrode 906 may be formed of and include one or more of graphite (e.g., high density graphite), a platinum-group metal (e.g., platinum, osmium, iridium, ruthenium, rhodium, and palladium), an oxygen evolving electrode, or another material. By way of example only, the counter electrode 906 may be formed of and include osmium, ruthenium, rhodium, iridium, palladium, or platinum. In some embodiments, the counter electrode 906 comprises one or more platinum-group metals (e.g., ruthenium, rhodium, palladium, osmium, iridium, and platinum), and one or more transition metals.

The reference electrode 912 may comprise any suitable material and is configured for monitoring a potential in the electrochemical cell of the electrochemical processing system 900. The reference electrode 912, may be in electrical communication with the counter electrode 906 and the working electrode 904 and may be configured to assist in monitoring the potential difference between the counter electrode 906 and the working electrode 904. Accordingly, the reference electrode 912 may be configured to monitor the cell potential of the electrochemical cell. The reference electrode 912 may include nickel, nickel/nickel oxide, glassy carbon, silver/silver chloride, one or more platinum-group metals, one or more precious metals (e.g., gold), or combinations thereof. In some embodiments, the reference electrode 912 comprises glassy carbon. In other embodiments, the reference electrode 912 comprises nickel, nickel oxide, or a combination thereof. In yet other embodiments, the reference electrode 912 comprises silver/silver chloride.

A potentiostat or a DC power supply (not illustrated) may be electrically coupled to each of the counter electrode 906, the working electrode 904, and the reference electrode 912. The potentiostat may be configured to measure and/or provide an electric potential between the counter electrode 906 and the working electrode 904. The difference between the electric potential of the counter electrode 906 and the electric potential of the working electrode 904 may be referred to as a cell potential of the electrochemical cell.

The coated articles 100, 500, 600, 700 may be used in various industries. In some embodiments, the coated articles may be used as radiation-resistant sensors. In some embodiments, the coated articles may be used as sensors in molten salt thermophysical measurements. In some embodiments, the coated articles may be used as anodes for high-energy uses such as x-ray anodes. In some embodiments, the coated articles may be used as containment structures such as in hot fusion reactors. In some embodiments, the coated articles may be used for the secondary production (recycling) of nuclear waste. In other embodiments, the coated articles may be used in the automotive, nuclear (e.g., molten salt reactor (MSR)), electronics, metal (e.g., aluminum), and defense industries.

The following examples serve to explain embodiments of the disclosure in more detail. These examples are not to be construed as being exhaustive or exclusive as to the scope of this disclosure.

Example 1

Fabrication of Titanium Carbide—Ruthenium (TiC—Ru) Article

An electrochemical cell experimental set up was housed in an argon atmosphere-controlled glove box. About 100 grams of eutectic ternary salt mixture (56.1 lithium bromide (LiBr)—18.9 potassium bromide (KBr)—25 Cesium Bromide (CsBr), wt. %) was prepared. To this 80 wt. % titanium tetrabromide ($TiBr_4$) was added. The salt mixture was melted, in a nickel crucible, and homogenized in the argon atmosphere-controlled glove box. A 6 millimeter (mm) diameter and 100 mm long titanium rod and 5 mm dia. graphite rod were used as anode and cathode, respectively. The melt temperature was maintained between 300° C. and 400° C. The mixture was melted and homogenized. Deposition of titanium onto the graphite was accomplished within a current density in the range 1076.39-3229.17 Amp/$m^2$. The duration of the deposit time ranged between 30 and 120 minutes. The titanium deposited graphite was taken out of the electrochemical cell, washed and put in an annealing furnace. The coated piece was annealed at 500° C. for a duration up to 12 hours to allow the titanium to diffuse from the surface to the bulk to form titanium carbide (TiC).

The annealed TiC described above was used as the cathode in conjunction with a 5 mm diameter and 100 mm long ruthenium rod. The eutectic ternary salt mixture was maintained between 40° C. and 500° C. for performing the plating experiments. A current density in the range 1614.58 Amp/$m^2$ to 4305.56 Amp/$m^2$ was applied to form a ruthenium coating on the surface of the TiC cathode. The duration of coating was in the range of 60 minutes to 180 minutes. A smooth, adherent and metallic gray coating was formed on the TiC. The ruthenium coated TiC was washed, dried and baked at a temperature of 150° C. to 200° C. for about 10 hours. The heat-treated ruthenium-coated TiC was examined under a microscope and was observed to include four layers: a base graphite, titanium carbide on the graphite, titanium-ruthenium carbide on the titanium carbide, and surface ruthenium.

The Ru—TiC article was subsequently exposed to in situ generated oxygen during the electrochemical reduction of two oxides (NiO and $Ta_2O_5$) in two electrolyte systems LiCl—$Li_2O$ and $CaCl_2$—CaO at 650° C. and 850° C., respectively. The cell voltages, during the reduction test runs, were maintained in the ranges of 2.0-2.5V and 2.5-3.1V, respectively. The duration of experiments was up to 10 hours and 12 hours, respectively. Both the oxide and the anode were removed from the cell for their subsequent evaluation and characterizations. The oxides were observed to undergo a fair degree of reduction (~95%). Upon removal of the adhered salt from the anode surface (by washing with water), the article was observed to maintain its mechanical integrity very well. No perceptible thinning or material loss, except a few tiny pits, could be observed on the surface. It is hypothesized that the same article could be utilized for a few more test runs without any damage.

Example 2

Fabrication of Molybdenum Carbide—Ruthenium (MoC—Ru) Article

80% molybdenum tribromide ($MoBr_3$) was mixed with the eutectic mixture described in Example 1 and the mixture was melted in a nickel crucible. The melt temperature was maintained at 500° C. A graphite rod (5 mm diameter and 100 mm long) and a molybdenum rod (3 mm diameter and 100 mm long) were employed as the cathode and anode, respectively. Molybdenum deposition on graphite was performed in a current density range of 2152.78 Amp/$m^2$ to 3767.37 Amp/$m^2$ and the duration of deposition varied between 45 minutes and 180 minutes. The molybdenum-deposited cathode was annealed in 600° C. for 12 hours to prepare a molybdenum carbide coated graphite rod.

The molybdenum carbide coated graphite rod was used as the cathode on to which ruthenium was electrodeposited from a LiBr—KBr—CsBr—$RuBr_3$ (80 wt. %) plating bath. The ruthenium electrodeposition was performed in a current density range of 1614.58 Amp/$m^2$ to 4305.56 Amp/$m^2$. The ruthenium-coated electrode was washed, dried and examined under a microscope to study its morphology. The article was observed to include a base graphite, molybdenum-ruthenium carbide, and ruthenium.

The article was tested for the electrochemical reduction of NiO and $Ta_2O_5$ in LiCl—$Li_2O$ and $CaCl_2$—CaO electrolytes, respectively. Upon the exposure of the article for more than 10 hours in each of these electrolytes, at 650° C. and 850° C., respectively, no perceptible anode damage could be seen. It is hypothesized that the Ru—MoC/$Mo^2C$ could be used in multiple testing and without any significant damage.

Example 3

Fabrication of Tantalum Carbide—Ruthenium (TaC—Ru) Article

Tantalum was electroplated from the ternary electrolyte, containing 80 wt. % Tantalum (V) Bromide ($TaBr_5$), in the temperature range of 300° C. to 350° C. The current density and the deposition duration were in the range of 2152.78 Amp/$m^2$ to 4843.76 Amp/$m^2$ and up to 200 minutes, respectively. The tantalum-coated specimen was annealed in a furnace at 500° C. for 12 hours to form the tantalum carbide (TaC) layer on the graphite. During the annealing, the bulk of the surface tantalum diffused (from the surface to the bulk) to form a thick TaC layer on the graphite.

Ruthenium was deposited onto the TaC cathode from the LiBr—KBr—CsBr—80 wt. % $RuBr_3$ plating bath by varying the current density in the range of 1614.58 Amp/$m^2$ to 4305.56 Amp/$m^2$ for a duration up to 120 minutes. The ruthenium-coated TaC electrode was washed, dried and examined under a microscope to study its morphology. The article was observed to be a composite article including a base graphite, tantalum-ruthenium carbide, and ruthenium.

The article was tested for the electrochemical reduction of NiO and $Ta_2O_5$ in LiCl—$Li_2O$ and $CaCl_2$—CaO electrolytes, respectively. Upon the exposure of the anode for more than 10 hours in each of these electrolytes, at 650° C. and 850° C., respectively, no perceptible anode damage could be seen. It is hypothesized that the Ru—TaC article could be used in multiple testing and without any significant damage.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A method of forming a metal-coated article, comprising:

electrodepositing a transition metal layer onto a substrate; and converting at least a portion of the transition metal layer to a transition metal carbide layer to form a transition metal region; and electrodepositing a platinum-group metal layer on the transition metal region; and converting at least a portion of the platinum-group metal layer to a transition metal/platinum-group metal layer on the platinum-group metal layer to form a platinum-group metal region.

2. The method of claim 1, wherein electrodepositing a transition metal layer onto a substrate comprises electrodepositing the transition metal layer at a temperature in a range of from about 350° C. to about 500° C.

3. The method of claim 2, wherein electrodepositing a transition metal layer onto a substrate comprises electrodepositing the transition metal layer from an electrolyte comprising LiBr, KBr, and CsBr.

4. The method of claim 1, wherein electrodepositing a platinum-group metal layer onto the transition metal region comprises electrodepositing the platinum-group metal layer from an alkali halide salt electrolyte at a temperature in a range of from about 350° C. to about 500° C.

5. The method of claim 4, wherein electrodepositing the platinum-group metal layer from an alkali halide salt electrolyte comprises electrodepositing the platinum-group metal layer from an electrolyte comprising LiBr, KBr, and CsBr.

6. The method of claim 1, wherein converting at least a portion of the transition metal layer to a transition metal carbide layer comprises annealing the substrate and the transition metal layer at a temperature from about 500° C. to about 600° C.

7. The method of claim 1, wherein converting at least a portion of the platinum-group metal layer to a transition metal/platinum-group metal layer comprises annealing the transition metal region and the platinum-group metal layer at a temperature from about 500° C. to about 600° C.

8. A method of forming a metal-coated article, comprising:

forming an as deposited transition metal layer on a substrate;

annealing the as deposited transition metal layer to convert at least a portion of the as deposited transition metal layer to a transition metal carbide layer;

forming an as deposited platinum-group metal layer on the transition metal carbide layer; and annealing the as deposited platinum-group metal layer to convert at least a portion of the as deposited platinum-group metal layer to a transition metal/platinum-group metal layer.

9. The method of claim 8, wherein annealing the as deposited transition metal layer to convert at least a portion of the as deposited transition metal layer comprises converting substantially all of the as deposited transition metal layer to the transition metal carbide layer.

10. The method of claim 8, wherein annealing the as deposited platinum-group metal layer to convert at least a portion of the as deposited platinum-group metal layer to a transition metal/platinum-group metal layer comprises forming the platinum-group metal layer and a platinum-group metal layer.

11. A method of forming a metal-coated article, comprising:

electrodepositing one or more transition metal layers onto a substrate layer from an electrolyte comprising an alkali metal halide; and converting at least a portion of the one or more transition metal layers to a transition metal carbide layer to form a transition metal region; and electrodepositing one or more platinum-group metal layers on the transition metal region; and converting at least a portion of the one or more platinum-group metal layers to a transition metal/platinum-group metal layer on the platinum-group metal layer to form a platinum-group metal region.

12. The method of claim 11, wherein converting at least a portion of the one or more transition metal layers to a transition metal carbide layer to form a transition metal region comprises converting at least a portion of the one or more transition metal layers to a transition metal carbide layer exhibiting a substantially homogenous chemical composition.

13. The method of claim 11, wherein converting at least a portion of the one or more transition metal layers to a transition metal carbide layer to form a transition metal region comprises converting at least a portion of the one or more transition metal layers to a transition metal carbide layer exhibiting a gradient of carbon in the transition metal carbide layer.

14. The method of claim 11, wherein converting at least a portion of the one or more transition metal layers to a transition metal carbide layer to form a transition metal region comprises converting at least a portion of the one or more transition metal layers to a transition metal carbide layer to form a transition metal region comprising a transition metal layer and a transition metal carbide layer, wherein a relative thickness of the transition metal carbide layer is greater than a relative thickness of the transition metal layer.

15. The method of claim 11, wherein converting at least a portion of the one or more transition metal layers to a transition metal carbide layer to form a transition metal region comprises converting at least a portion of the one or more transition metal layers to a transition metal carbide layer to form a transition metal region comprising a transition metal layer and a transition metal carbide layer, wherein a ratio of a thickness of the transition metal carbide layer to a thickness of the transition metal layer is about 3:1.

16. The method of claim 11, wherein electrodepositing one or more platinum-group metal layers on the transition metal region comprises electrodepositing one or more of platinum, palladium, rhodium, iridium, ruthenium, and osmium.

17. The method of claim 11, wherein electrodepositing one or more platinum-group metal layers on the transition metal region comprises electrodepositing one or more of ruthenium and osmium.

18. The method of claim 11, wherein converting at least a portion of the one or more platinum-group metal layers to a transition metal/platinum-group metal layer on the platinum-group metal layer to form a platinum-group metal region comprises converting at least a portion of the one or more platinum-group metal layers to a transition metal/platinum-group metal layer exhibiting a homogeneous chemical composition of the transition metal and the platinum-group metal.

19. The method of claim 11, wherein converting at least a portion of the one or more platinum-group metal layers to a transition metal/platinum-group metal layer on the platinum-group metal layer to form a platinum-group metal region comprises converting at least a portion of the one or more platinum-group metal layers to a transition metal/platinum-group metal layer exhibiting a heterogeneous chemical composition of the transition metal and the platinum-group metal.

20. The method of claim 11, wherein converting at least a portion of the one or more platinum-group metal layers to a transition metal/platinum-group metal layer on the platinum-group metal layer to form a platinum-group metal region comprises converting at least a portion of the one or more platinum-group metal layers to a transition metal/platinum-group metal layer that exhibits a chemical composition that transitions between a chemical composition of the transition metal region and a chemical composition of the platinum-group metal region.

* * * * *